US006227544B1

(12) United States Patent
White et al.

(10) Patent No.: US 6,227,544 B1
(45) Date of Patent: May 8, 2001

(54) CARD GAME FOR THE SIMULATION OF A SPORTS GAME

(75) Inventors: Thomas White, Monks Eleigh; Giannetto Mariani, Ipswich; Simon Knock, Felixstowe; Michael Chilcott, Ipswich, all of (GB)

(73) Assignee: Upstarts, Suffolk (GB)

( * ) Notice: Subject to any disclaimer, the term of this patent is extended or adjusted under 35 U.S.C. 154(b) by 0 days.

(21) Appl. No.: 09/355,076

(22) PCT Filed: Jan. 21, 1998

(86) PCT No.: PCT/GB98/00182

§ 371 Date: Jul. 22, 1999

§ 102(e) Date: Jul. 22, 1999

(87) PCT Pub. No.: WO98/32505

PCT Pub. Date: Jul. 30, 1998

(30) Foreign Application Priority Data

Jan. 23, 1997 (GB) ..... 9701320

(51) Int. Cl.[7] ..... A63F 1/02
(52) U.S. Cl. ..... 273/296
(58) Field of Search ..... 273/296, 298, 273/308

(56) References Cited

U.S. PATENT DOCUMENTS

| | | | | |
|---|---|---|---|---|
| 1,485,146 | * | 2/1924 | Mundell | 273/296 |
| 4,468,037 | * | 8/1984 | Kuhn | 273/296 |
| 4,793,617 | | 12/1988 | Sanon . | |
| 5,118,109 | | 6/1992 | Gumina . | |
| 5,221,091 | * | 6/1993 | Gallegos et al. | 273/296 |
| 5,316,482 | * | 5/1994 | Bryson | 273/236 |
| 5,496,036 | * | 3/1996 | Chester | 273/296 |
| 5,654,050 | * | 8/1997 | Whalen-Shaw | 273/292 |

FOREIGN PATENT DOCUMENTS

| | | | | |
|---|---|---|---|---|
| 27 26 550 | | 6/1979 | (DE) . | |
| 0 229 002 | | 7/1987 | (EP) . | |
| 0 810 012 A1 | | 12/1997 | (EP) . | |
| 2205254 | * | 12/1988 | (GB) | 273/254 |
| 2 216 020 | | 10/1989 | (GB) . | |
| 2 218 342 | | 11/1989 | (GB) . | |

OTHER PUBLICATIONS

Lawyers' Edition Technicality Cards, Playthings p. 80, May 1985.*

* cited by examiner

*Primary Examiner*—Jeanette Chapman
*Assistant Examiner*—Raeann Gorden
(74) *Attorney, Agent, or Firm*—Howell & Haferkamp, LC

(57) ABSTRACT

Apparatus for playing a game, particularly a simulated sports game, comprises a set of opaque cards, each card having two opposite faces carrying markings used in playing the game. Each face of each card is subdivided into discrete regions with the number and arrangement of the regions being the same on all faces of all cards. The cards are divided into two sets, one for each opposing team. One face of each card carries, inter alia, a representation of a ball, and the opposite face carries, inter alia, a representation of a defending player.

11 Claims, 8 Drawing Sheets

CARD GAME FOR THE SIMULATION OF A SPORTS GAME

The present invention relates to apparatus for playing a game, notably to a card game which can for example be related to a sports game.

There is always a demand for simple, easy to play but exciting games, especially games which can be played internationally and which do not demand a knowledge of any particular language, games which can be carried around in a pocket or in a small bag are likewise desirable.

According to the present invention there is provided apparatus for playing a game, the apparatus comprising a set of cards, each card having two opposite faces carrying markings used in playing the game, each face of each card being subdivided into discrete regions, with the number and arrangement of the regions being the same on all faces of all cards.

The game preferably relates to a sport played between two teams or two individuals. Accordingly, the cards may carry representations of sports competitors or sports equipment. Half the cards may be allocated to one team or individual, and half to the other. In a preferred embodiment, one face of each card carries markings related to attack ("attack surface"), and the other face of each card carries markings related to defence ("defence surface").

By having the same number and arrangement of regions on both sides of each card, a region of an attack surface can be related to a corresponding region on a defence surface. Players may readily switch from attacking to defending by turning over their cards, as will be described in more detail later.

In one embodiment, the game is based on football (soccer), but the invention is not limited to this embodiment. The game may be based on other sports or games, including American football, Australian Rules Football, baseball, basketball, tennis, cricket, hockey, ice hockey, rugby union, rugby league, volleyball, tennis, badminton and the like. For convenience hereinafter, the invention will be described with reference to a game based on football, but it is to be understood that the invention is not limited to this embodiment.

Each face of each card is preferably divided into six main regions, although other numbers of regions could also be used. The divisions of the card may be delineated by lines printed on the card or, where the number of regions is small (eg 4 or 6) or where the cards are large, it may be unnecessary to print any lines as the players will be able to judge by eye the different regions. The regions are preferably all equal in area.

Any number of cards may be used, but it is preferred that each player have a number of cards which is equal to the number of minutes in the game or sport on which the card game is based, or a defined period of that game or sport, for example a half. In a football game, for example, each player may have 45 cards, one for each minute of a half. Other specialist cards may be used in addition to the 45 cards, for example cards relating to free kicks, penalties, defensive walls, and goalkeeping.

Other cards may optionally be included; for example, one or more cards which carry rules for the game, or a card which carries a team photograph or cartoon. A player's cards may represent a real team, such as Manchester United, Newcastle United, Juventus, New York Giants, Phoenix Cardinals. In this case the cards may carry representations of that team's colours, insignia, team badge and so forth.

According to a second aspect, there is provided apparatus for playing a game, the apparatus comprising at least one card and a printed sheet, the card and the sheet each having one playing face carrying markings used in playing the game, the playing face of the card being subdivided into discrete playing regions, and the playing face of the sheet being subdivided into a plurality of areas, each area being subdivided into playing regions with the number and arrangement of the playing regions being the same on the card and on the sheet.

This apparatus can include a number of cards, and some of the cards (or some of the areas of the sheet, may be provided initially with a scratch-off opaque coating.

Advertising elements may be featured on same or all of the cards, in a manner analogous to the sponsorship of teams by companies or to advertisements placed around sports stadiums. In particular, advertising may be featured on a team strip or sports shoe or boot or as part of the background scene on a card.

The information on the cards may comprise words, letters, numbers, symbols, pictograms, icons, pictures or other insignia. However it is preferred that the information on the cards comprises symbol, pictures or the like, so that the game can be played by and between players regardless of their own language. This allows the game to be readily played between players from different countries.

The invention will now be further described, by way of example only, with reference to the accompanying drawing in which FIGS. 2 to 6 show cards for use in playing a game based an football (soccer) and in which:

FIG. 1 is a representation of a card which will be suitable for use in the invention when provided with markings for use in a game;

FIGS. 2*a*–2*d* show attack surfaces of cards in accordance with an aspect of the invention;

FIG. 3 shore an attack surface of a card in accordance with another aspect of the invention;

FIGS. 4*a*–4*d* show defence surfaces of cards in accordance with an aspect of the present invention;

Figure 7A:
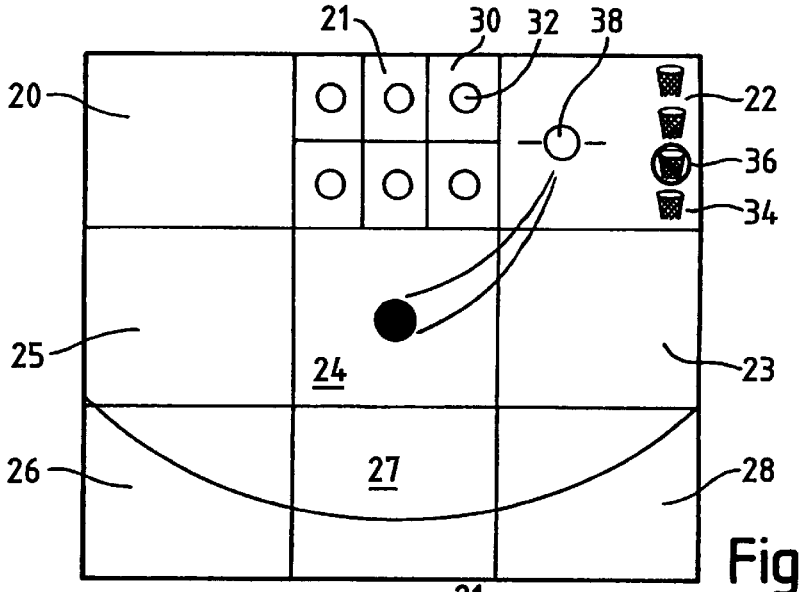
Figure 7B:
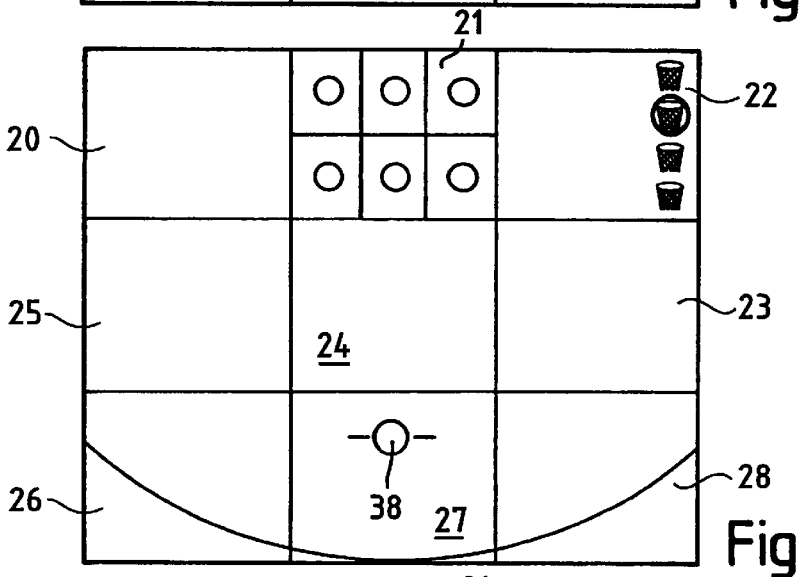
Figure 7C:
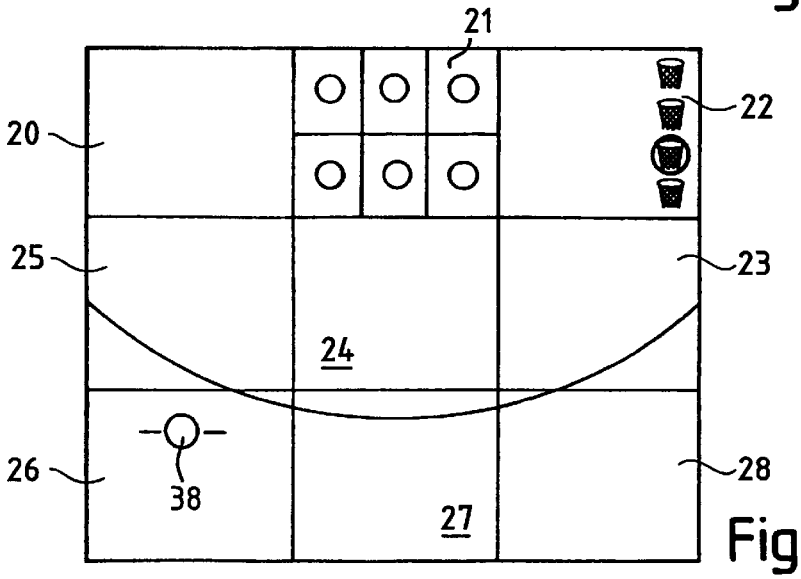
Figure 8A:
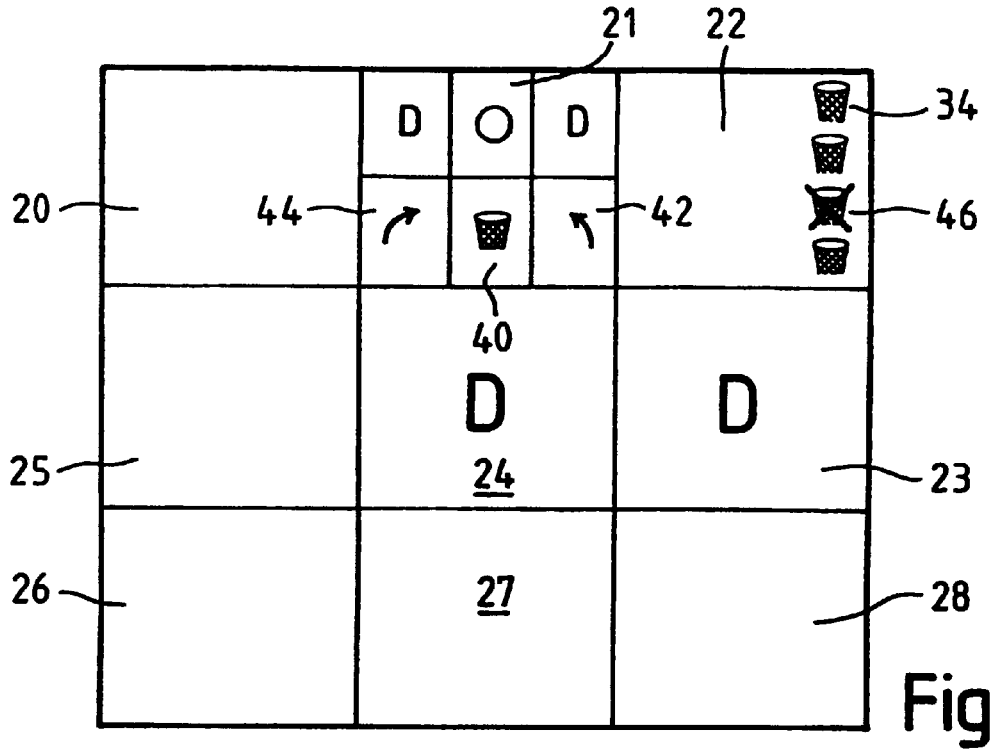
Figure 8B:
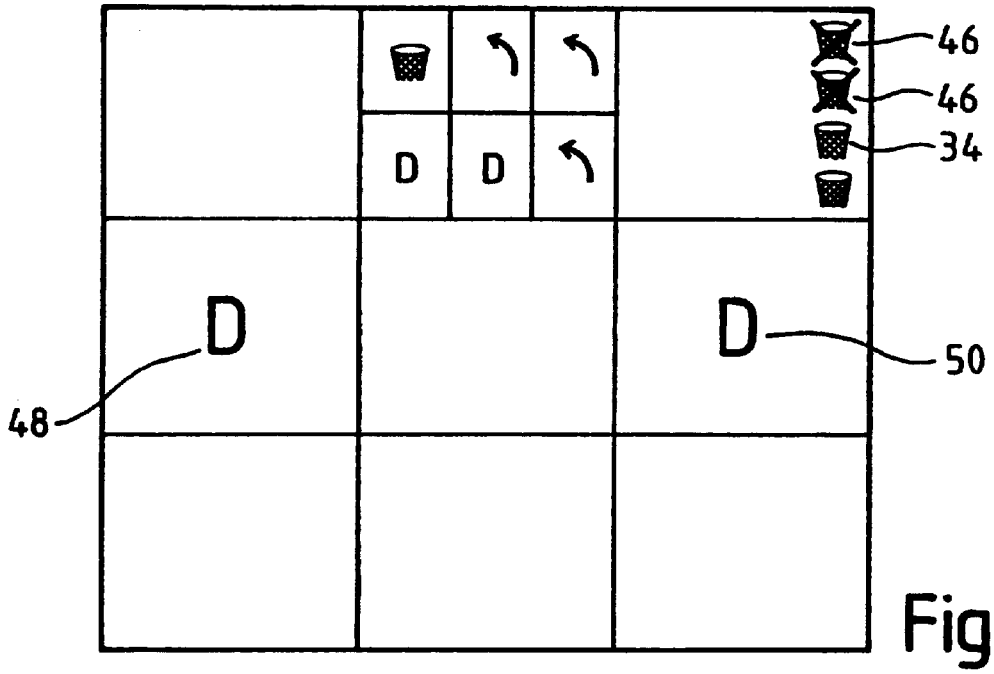

FIGS. 7*a*–7*c* shows attack surfaces of cards in accordance with a second aspect of the invention; and FIGS. 8*a* and 8*b* show defence surfaces of cards in accordance with the second aspect of the present invention;

The cards comprise two "teams", with each team being allocated one pack of 45 game cards, 6 goalie/penalty cards, and 6 free kick wall/free kick shot cards. One face of each game card relates to attack (ie that side has possession of the ball), and the other face of each card relates to defence (ie that side does not have possession).

Figure 1:
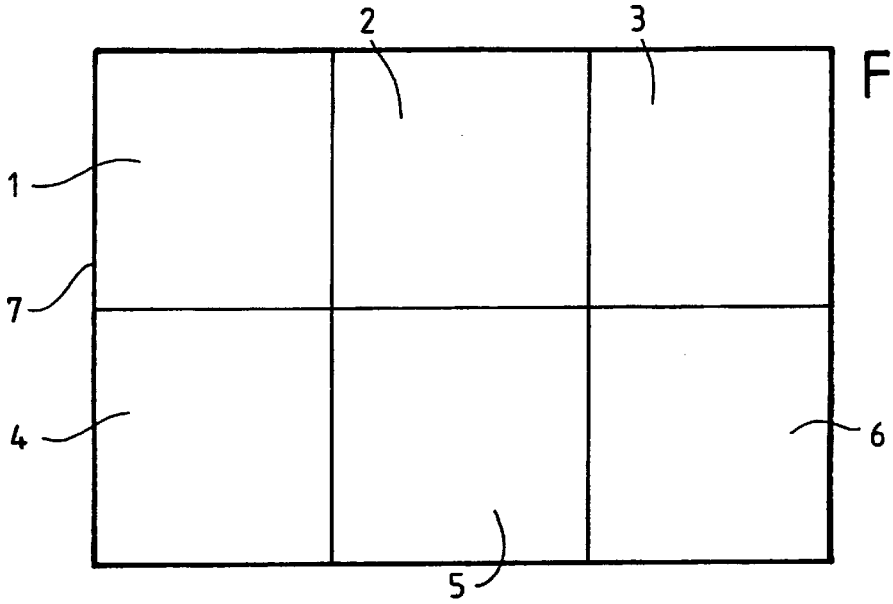

Each card 7 is subdivided, on both sides, into six regions of equal size. These regions are labelled 1 to 6 in FIG. 1, and this labelling will be used when referring to specific regions of any surface of any card.

Figure 2A:
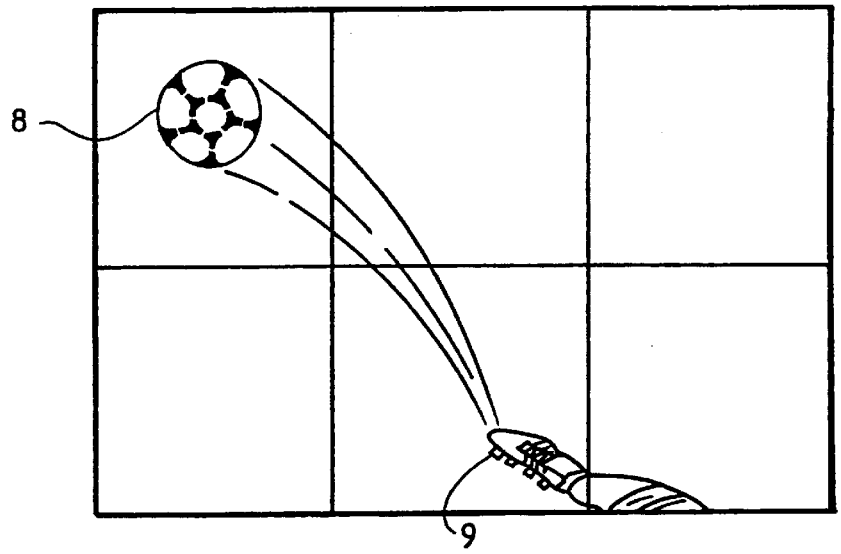
Figure 2B:
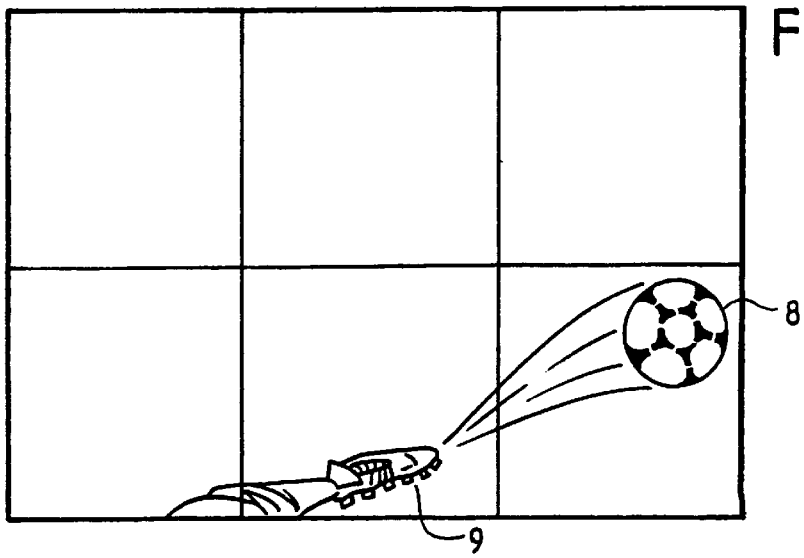
Figure 2C:
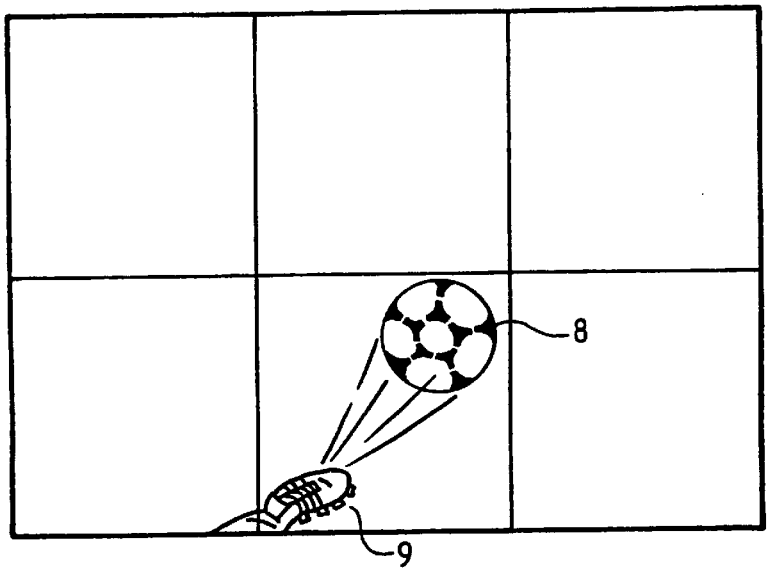
Figure 2D:
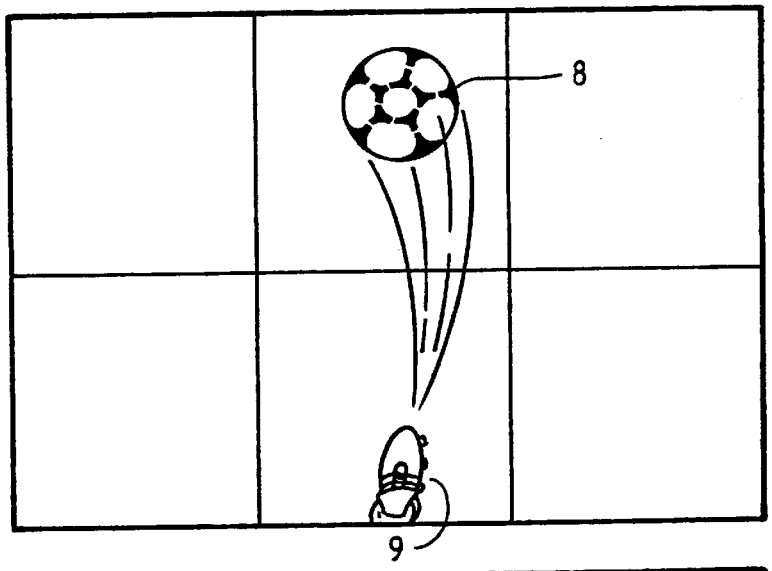

All attack surfaces depict a ball 8 which is being kicked by a player's boot 9. The ball 8 is located in region 1 in FIG. 2*a,* in region 6 in FIG. 2*b,* in region 5 in FIG. 2*c,* and in region 2 in FIG. 2*d.* The ball 8 may occupy any one region of the attack surface. The position of the boot 9 is not important. If the ball is always shown in a central position within one of the regions 1 to 6, the lines which divide the regions may be omitted, because it will be simple to judge which region the ball is in.

Figure 3:
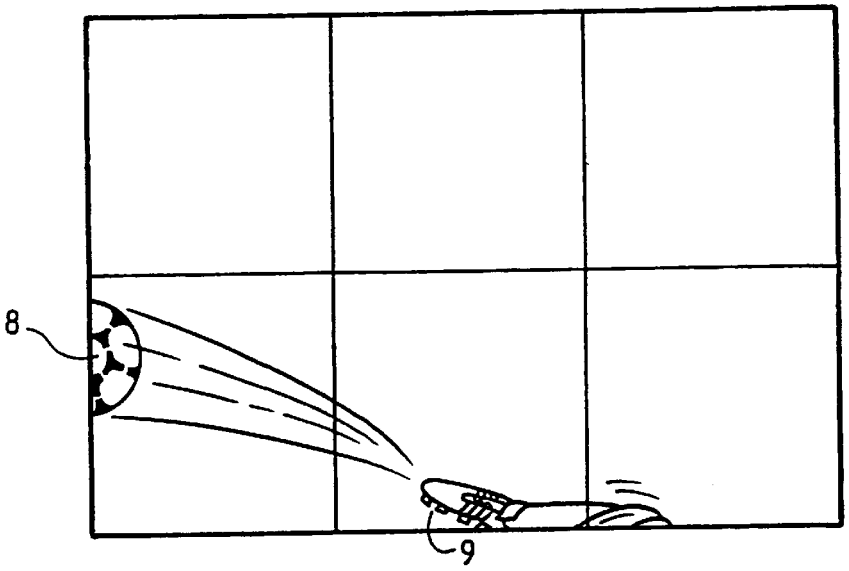

The ball 8 in FIG. 3 is depicted only partly in region 4, representing a ball which has gone out of play.

Referring new to FIG. 4, there are shown examples of defence surfaces of cards 7. One or more defenders 10 occupy or block regions of the defence surface. Each defence surface region corresponds to a similarly positioned attack surface region. Defenders 10 block regions 5 and 6 in FIG. 4*a,* regions 2 and 5 in FIG. 4*b,* regions 1 and 4 in FIG. 4*c,* regions 2, 3 and 6 in FIG. 4*d,* regions 2, 3 and 5 in FIG. 4*e,* regions 1, 2, 4 and 5 in FIG. 4*f,* regions 1, 4, 5 and 6 in FIG. 4*g,* regions 1, 3 and 6 in FIG. 4*h,* and regions 3 and 6 in FIG. 4*i.*

Different defenders 10 may occupy more or fewer regions, depending on their ability and/or the ability of the team.

Figure 4A:
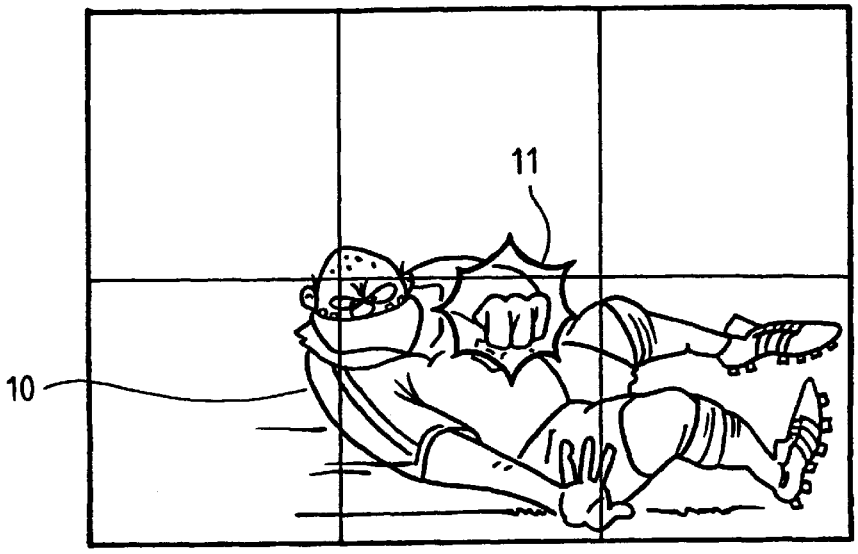
Figure 4B:
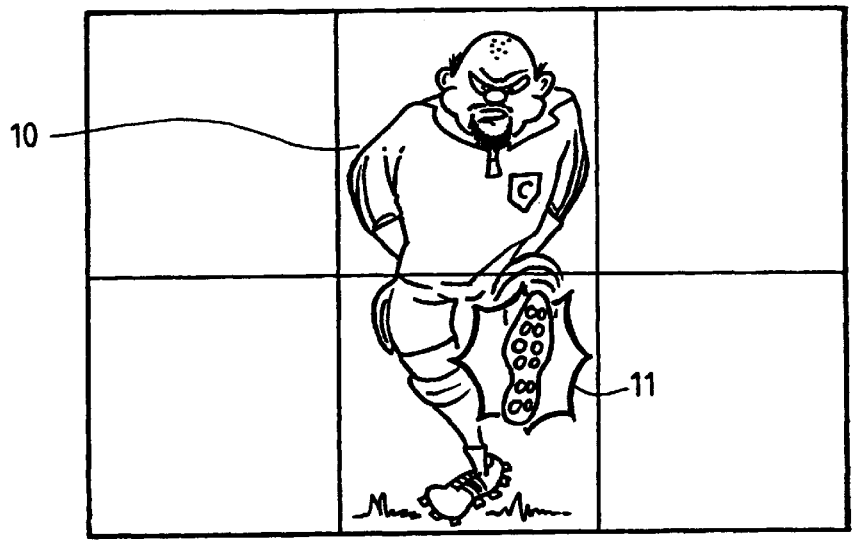
Figure 4C:
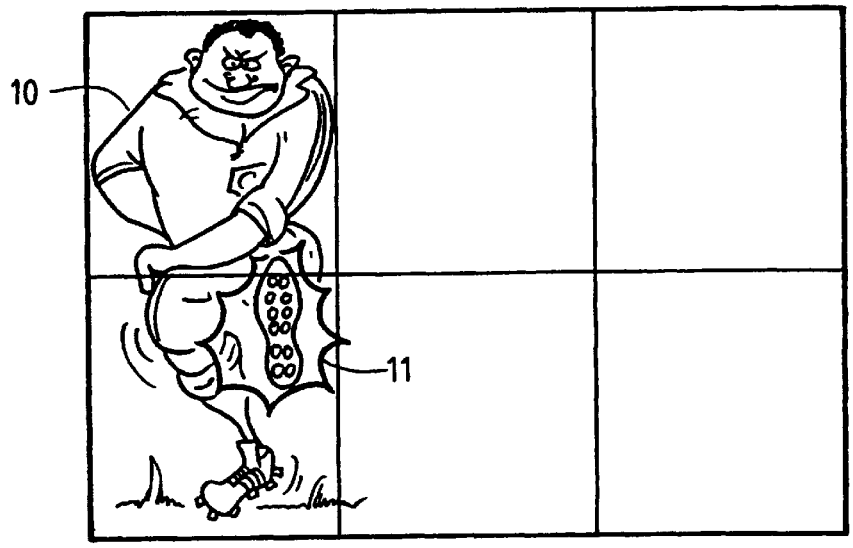
Figure 4D:
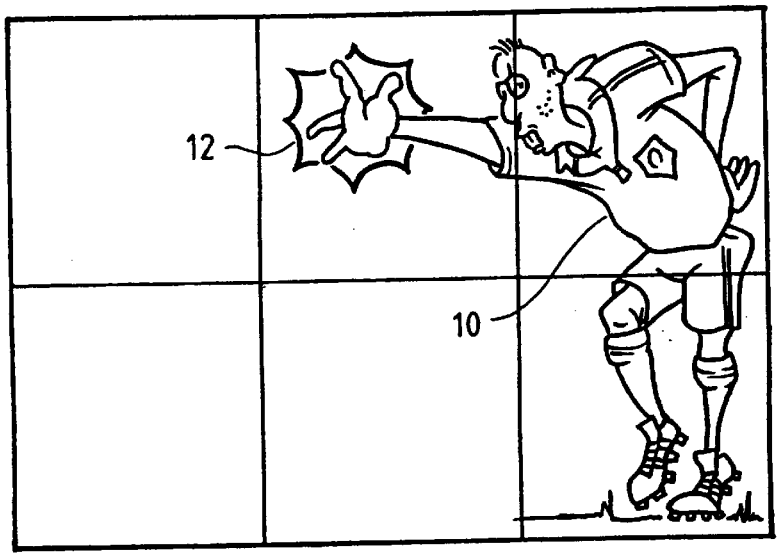
Figure 4E:
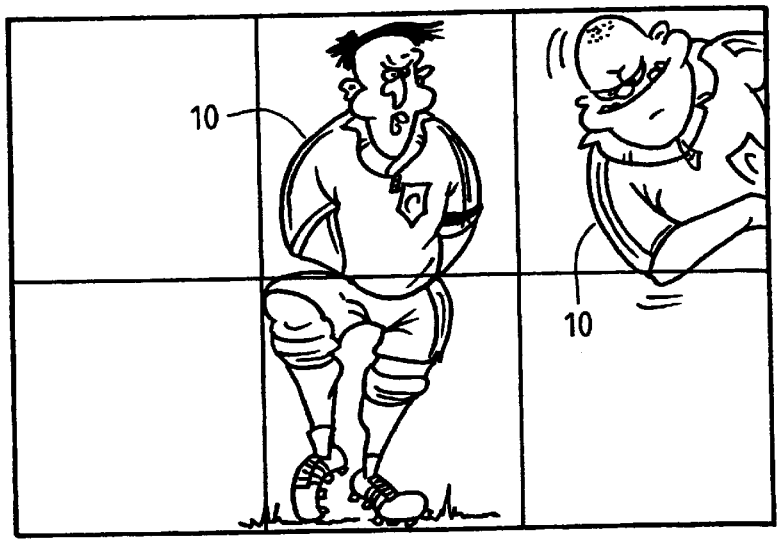
Figure 4F:
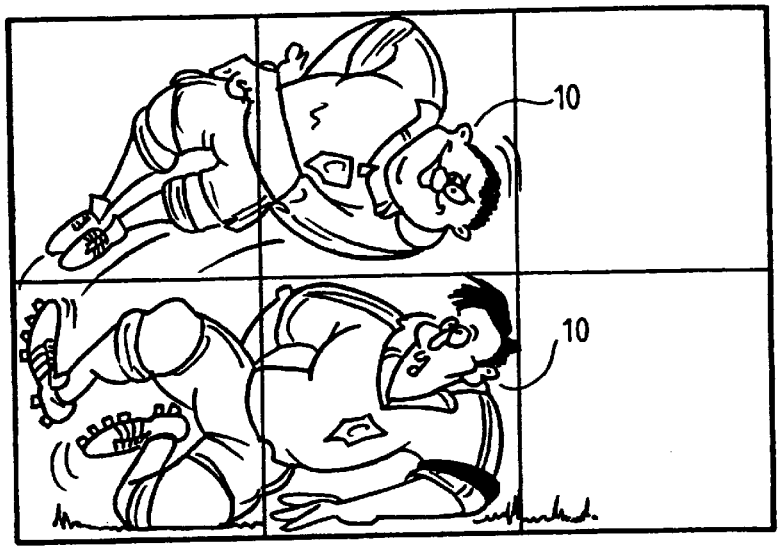
Figure 4G:
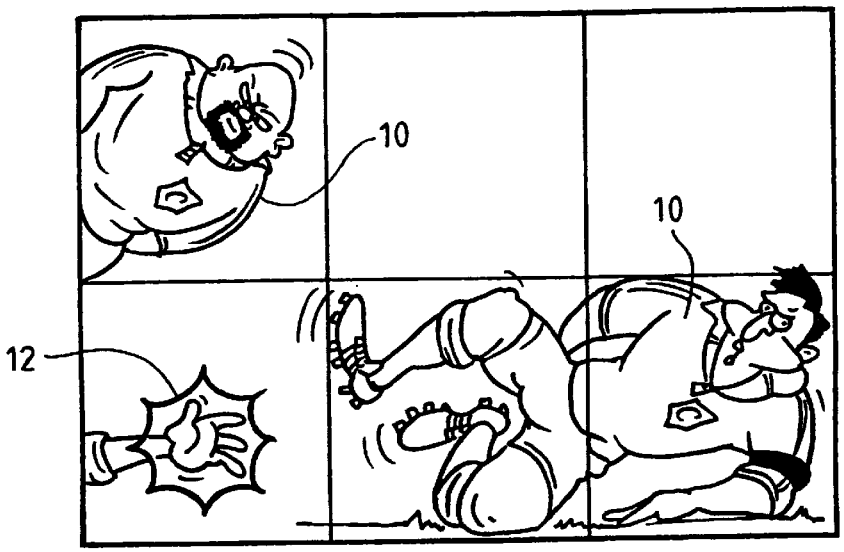
Figure 4H:
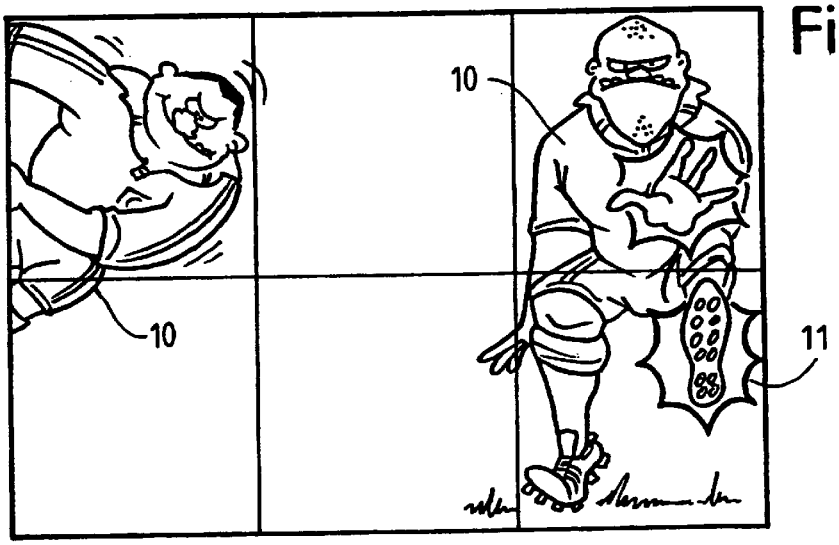
Figure 4I:
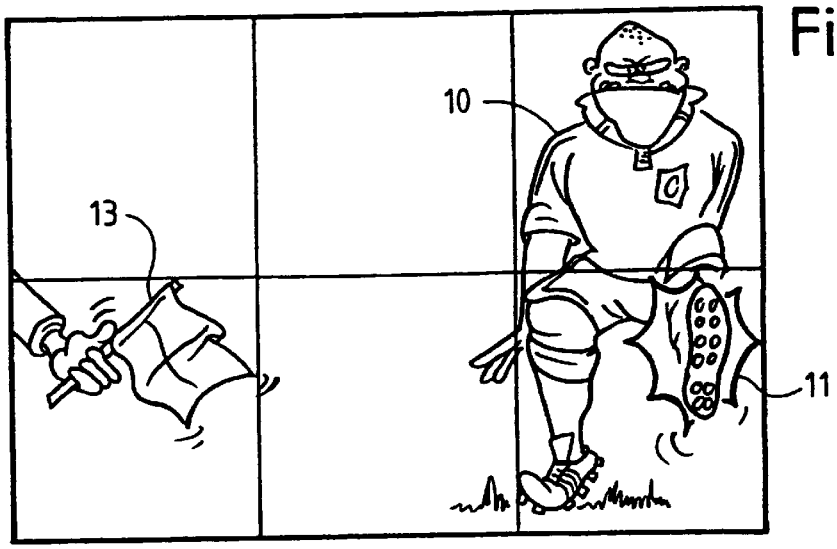

A star 11, 12 is used to show that the defender to has committed a foul or handball respectively. Examples of foul regions 11 are shown in FIGS. 4*a*/*b* (region 5). FIG. 4*c* (region 4), FIG. 4*h* (regions 3 and 6). FIG. 4*i* (region 6). Examples of handball regions 12 are shown in FIG. 4*d* (region 2) and FIG. 4*g* (region 4). A flag 13 is used to denote an offside player, as shown in FIG. 4*i.*

Figure 5:
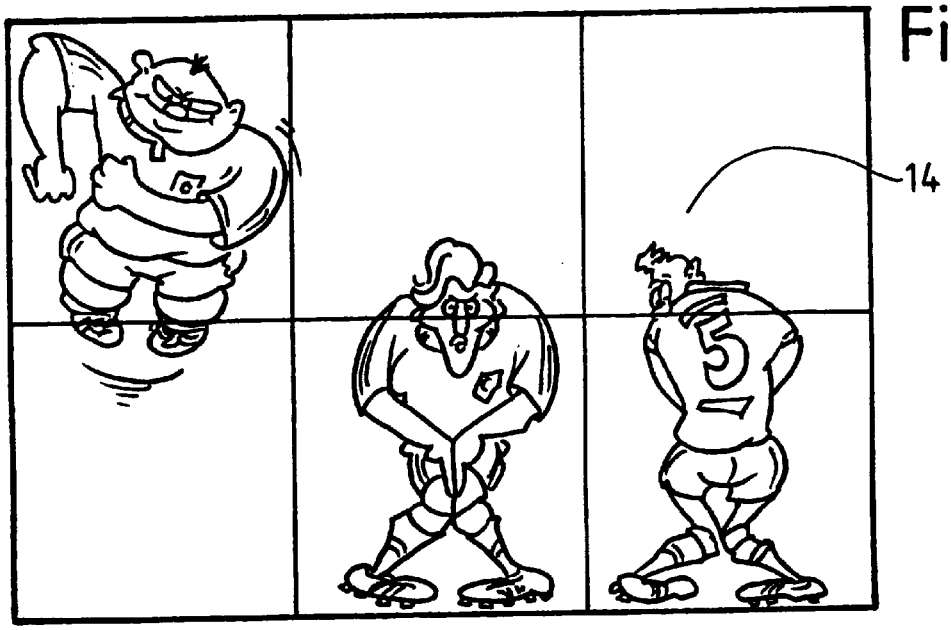
FIG. 5 shows a defence surface of a card in accordance with a further aspect of the invention.

FIG. 5 shows an example of a defensive wall 14. A defensive wall 14 is used when a free kick is awarded, as will be explained in more detail below. The wall 14 occupies regions 1, 5 and 6. Many other combinations of regions may of course also be blocked by the wall.

Figure 6:
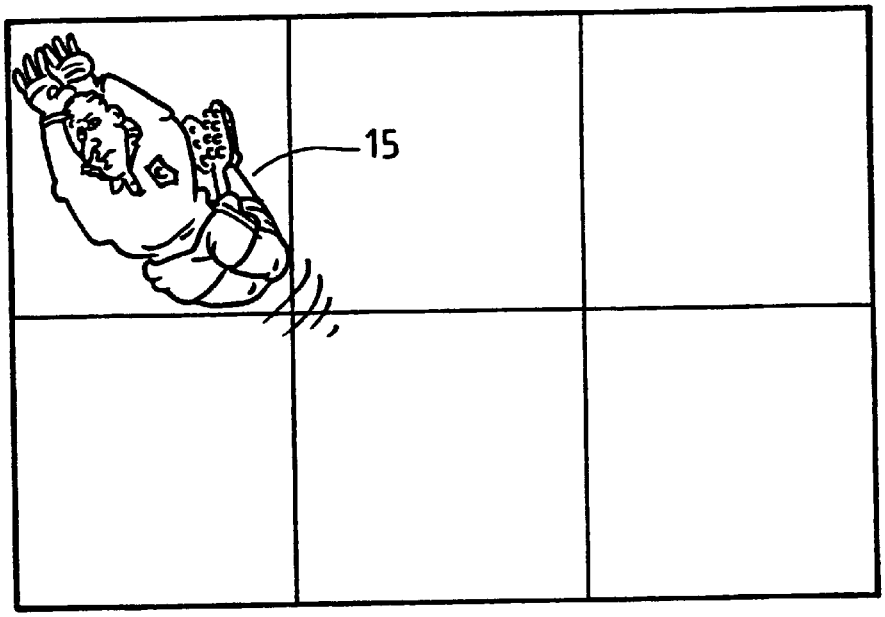
FIG. 6 shows a defence surface of a card in accordance a still further aspect of the invention.

FIG. 6 shows a goalkeeper 15 in region 1. There are six goalie/penalty cards for each player, in each of which the goalkeeper 15 occupies a different region.

Each card which has a defence surface as exemplified in FIG. 4, has an attack surface as exemplified in FIG. 2 or FIG. 3. These cards will be referred to hereinafter as "game cards".

Each card which has a defence surface as exemplified in FIG. 5, has an attack surface as exemplified in FIG. 2. These cards will be referred to hereinafter as "free kick cards".

Each card which has a defence surface as exemplified in FIG. 6, has an attack surface as exemplified in FIG. 2. These cards will be referred to hereinafter as "goalie/penalty cards".

Any surface of any card may include pictures of turf, crowds, a stadium, and so forth. Where a real team is represented, the crowd may be shown in the team's colours. A goalkeeper card may show a goal with goal posts as a background.

PLAY

At the start of play each player takes a set of cards which represents a team. Each player holds his pack of 45 game cards with all the attack surfaces facing the same way, and puts to one side the other 12 cards. A coin is tossed to determine who "kicks off" to begin the first half. Each half lasts until each player has played all his 45 cards, and this notionally corresponds to 45 minutes of play.

The team which wins the toss kicks off, and begins as the attacking team. The kick off is done by the attacking player placing down a game card with the attack surface facing up. At the same time the defending player plays a game card with the defence surface face up. A player cannot choose which game card to play, he must take each card in its sequence in the pack. The player representing the attacking team will thus keep his cards with the attack surfaces face up, and the player representing the defending team will keep his cards with the defence surfaces face up.

The attack and defence cards are then compared. If the ball 8 on the attacking player's card is in a region not occupied by a defender 10 on the defending player's card, this constitutes a successful attack, and the attacking player remains in possession of the ball, ie on the attack. Play proceeds with each player playing another game card as before. If the ball 8 coincides with a defender 10 the shot is blocked. When the ball is blocked, possession of the ball changes from one team to the other which then becomes the attacking team. The players then turn over their decks of game cards and the defending team becomes the attacking team, and vice versa.

If the attacking player achieves three successful attacks, the next game card played is then a shot at goal (ie a shot in the area). A goalie card is selected by the defending player and added to his game card in order to try to block the next shot. The shot at goal is blocked if the location of the ball 8 on the attacking player's card coincides with the position of a defender 10 on the game card or of the goalkeeper 15 on the goalie card.

After a goal the game restarts with the team which has conceded the goal taking a centre kick (ie starting a first attack).

FREE KICKS

A foul is committed if the ball 8 coincides with a foul region 11, and a handball is committed if the ball 8 coincides with a handball region 12. A foul and a handball will be referred to as "an offence". If an offence occurs on the first attack then the next play of the cards is deemed to be the third attack. If an offence occurs on the second attack then the next play of the cards is deemed to be a shot in the area. If an offence occurs on the third attack, a free kick (outside the area) is awarded.

For the free kick, the game cards are temporarily put aside and each player secretly selects a free kick card of his choosing. The defender also secretly selects a goalie card. All three cards are then played. If the ball 8 coincides with a defender in the wall 14 or the goalkeeper 15 the shot is blocked, otherwise a goal is awarded.

PENALTIES

If an offence is committed during a shot in the area (ie a shot at goal) a penalty is awarded.

The game cards are put aside and both players secretly select a goalie/penalty card. The cards are then played and a goal is scored unless the ball 8 is located in a region corresponding to the region in which the hands of the goalkeeper 15 are located.

THROW INS, GOAL KICKS AND CORNERS

If an attack surface of a played card shows a ball 8 that has gone out of play and no defender 10 occupies the region where the ball 8 is depicted, a throw in is awarded (unless the attacker is making a shot in the area, when a goal kick is awarded). In either case, the defending team takes possession and both sets of cards are turned over. The defending team becomes the attacking team and play continues with the new attacking team making their first attack.

If the ball that has gone out of play coincides with a defender 10 (but not a foul or handball region) then a throw in is awarded to the attacking team and the attacking team begins a new first attack (unless the attacker is making a shot in the area, in which case a corner is awarded if the ball 8 which is going out of play coincides with a defender 10 or the goalkeeper 15).

To take a corner, the attacking team plays the next game card, and the defending team play the next game card and a goalie card. If the defending team do not gain possession the next attack is a shot at goal. The defending team again plays a game card and a goalie card. If the ball goes into an unoccupied region then a goal is awarded. If a shot in the area is taken but the card shows a ball that is going out of play, and if no defender 10 or goalkeeper 15 coincides with the ball 8, a goal kick is awarded.

In all cases, where the ball is going out of play and the ball coincides with an offence region (foul or handball), the offence takes precedence and the appropriate steps are taken, as set forth above.

OFFSIDE

If the ball 8 lands in a region occupied by a flag 13 then offside is awarded and the defending team takes possession.

At the end of the first half, both players sort their cards so that they face the same way, shuffle their cards, and play then restarts with the player who kicked off the first half, defending.

Each "team" (ie a deck of 45 cards plus auxiliary cards) may be sold separately, so that matches may be played between preferred teams in the UK Premier Football, or other leagues. Optionally, some teams could be stronger than others, ie more likely to win. In a preferred embodiment this is achieved by the defenders of the stronger team occupying more regions, on average, than the defenders of weaker teams, and therefore conceding fewer goals. However it would also be possible to increase the goal scoring abilities of a stronger team, for example by having some attack surfaces show more than one ball, only one ball having to match with a space for a successful attack.

FIGS. 7 and 8 show examples of cards used in playing a game based on basketball.

As for football, the game is for two players.

Each player has 60 cards. One player attacks, the other defends. The sixty cards are all divided into nine main squares 20 to 28.

FIGS. 7*a,* 7*b* and 7*c* show examples of the attack side of the basketball cards. The middle square 21 in the top row represents the backboard on a basketball court and is subdivided into six squares. A basketball 32 is in each of the six squares 30. These six basketballs will all be different colours. In the top right hand corner square 22 are four baskets 34, of which one 36 has a basketball superimposed on it. If this basket is not in the same position as a basket on a defenders card with a cross superimposed on it then a free throw point is awarded. Of course none of the 'squares' have to be geometric squares.

One of the squares on the attack side of the card shows a player who is either in a shooting, passing or dribbling position. In FIG. 7*a,* the player 38 is in a passing position in square 22; in FIG. 7*b* the player 38 is in a shooting position in square 27 and in FIG. 7*c* the player 38 is in a dribbling position in square 26.

FIGS. 8*a* and 8*b* show examples of two defender cards. The middle square 21 of the top three squares in each case contains a square subdivided into six smaller squares 30. This resembles a backboard—one of these six squares 40 contains a hoop/net, others 42, 44 contain an arrow, which are counted as successful rebound shots, and the remaining squares contain either a D or an O, relating to defence and offense (attack). In the top right hand corner are four baskets 34, one or two of which have a superimposed cross 46. These four baskets when placed next to an attack card show whether a free throw is successful or not.

The defence cards show some squares 48, 50 containing the letter D. These letters D represent defending players.

Play proceeds in much the same manner as described for football. One player lays an attack card and the other player lays a defence card. The attack and defence cards are laid next to each other and the position of the attacker is viewed in relation to the position of the defenders. If the attacker is in a square that is not occupied by a defender and he is in a shooting position, the attacker chooses a coloured ball on the backboard and the defender turns over another card. The square chosen by the attacker (by reference to a particular coloured ball) is compared with the six small squares on the defenders card, and the attacker hopes that the colour ball chosen occupies the corresponding square to a basket on the defender's card.

In another example, a description will be given of a game based an baseball. The game is played by two players.

Four cards (not shown) depict the four bases in baseball, these are laid down and act as the play area.

Each player holds 48 cards. One player is the pitcher (bowler) the other is the batsman. The pitcher's cards are divided into nine squares and show the ball being bowled into one of these nine squares.

The batsman's cards are also divided into nine squares and show three squares occupied by a bat. The remaining six squares show either the word STRIKE or BALL (no-ball).

If the ball hits a STRIKE or BALL square another card is played by both players. If the pitcher bowls three strikes before the batsman hits the ball the batsman is out.

When the ball is in a square occupied by a bat, both players flip over their cards. The batsman's cards show where on the field the ball has been hit and the pitcher's cards show where on the field the fielders are positioned. In some squares, the fielder is shown in a catching position, by a picture of an open glove. If the ball lands in a square occupied by an open glove the batsman has been caught out. If there is no glove or fielder in the square the square will show how many bases can be run by the batsman.

There are six other cards per team. One side is a tagging side and the other side is a run-out side. These are used occasionally similarly to the free kick cards in the football game described above.

An innings per team ends when three players are out.

Although the invention has been illustrated with reference to embodiments based on the games of football (soccer), baseball and basketball, it is to be understood that it is not limited to these embodiments, or indeed to any specific known sports game. However once the essential elements of the game are understood it will be realised that the invention may relate to many other known sports games. For example the ball may be depicted as a rugby ball or an American football, and the defenders may be rugby players or American football players. In another example, the ball may be a baseball, and the "defending" side could be depicted as hitters. Three "attacks" would correspond to three strikes. Other cards could be used to depict action in the infield.

In another embodiment, a game according to the invention can be played by a single player, in a form which is particularly suitable for use as a promotional activity where the single player plays for a prize.

In this type of game, one of the sets of cards is replaced by a single sheet on which, say, four diagrams or pictures corresponding to, for example, four defender cards as described above. The player is then provided with an attack card with a scratch-off coating covering the six squares on the card. The player scratches off the coating from one of the six squares on the first 'attack' card to see whether the ball is in a square corresponding to an unoccupied square on the first defence picture. If the player has uncovered a ball in a square corresponding to an unoccupied square, then he/she moves on to the next attack card and the next defence picture, with the aim being to uncover the correct squares on the scratch cards to 'beat' all the defence pictures, and thus to win the game. However if an attack card is scratched in a square where there turns out to be no ball, then the game is lost.

It will be apparent that there could be many variations on this type of game, depending on the nature of the sport being depicted, the number of cards used and the particular rules employed.

What is claimed is:

1. Apparatus for playing a game, the apparatus comprising a set of opaque cards, each card having two opposite faces carrying different pictorial markings used in playing the game, each face of each card being subdivided into discreet regions, with the number and arrangement of the regions being the same on all faces of all cards.

2. Apparatus for playing a game is claimed in claim 1, wherein each face of each card is subdivided into six regions.

3. Apparatus as claimed in claim 1, wherein the regions are divided by printed lines.

4. Apparatus for playing a game as claimed in claim 1, wherein all the regions are of substantially the same size and shape.

5. Apparatus for playing a game as claimed in claim 1, wherein at least one region of one face of at least one card carries a representation of a ball for a sports game, and wherein at least one region of the other face of the card carries a representation of a defender in a sports game.

6. Apparatus for playing a game as claimed in claim 5, wherein the game ball is a football, and the defender is a football defender.

7. Apparatus for playing a game as claimed in claim 1, which further includes one or more extra cards wherein at least one region of one face of at least one card carries a representation of a football, and wherein of the other face of the or each extra card carries a representation of a goalkeeper.

8. Apparatus for playing a game as claimed in claim 7, wherein the number of extra cards which carry a representation of a goalkeeper is at least equal to the number of regions on a face of a card, for each region there being a card which carries a representation of a football in that region, and for each region there being a card which carries a representation of a goalkeeper in that region.

9. Apparatus for playing a game as claimed in claim 5, wherein at least one region of one face of at least one card carries a representation of an attacking player in a sports game, and wherein at least one region of the other face of the card carries a representation of a defending player in the same sport game.

10. Apparatus as claimed in claim 9, wherein the game is basketball and one region on each side of each game card is subdivided into smaller regions, at least one of which one the defending side of the card represents a basket.

11. Apparatus for playing a game as claimed in claim 5, wherein at least one card carries a marking which represent the commission of an offence against the rules of the sports game.

* * * * *